US010482894B2

(12) United States Patent
Osawa et al.

(10) Patent No.: US 10,482,894 B2
(45) Date of Patent: Nov. 19, 2019

(54) DEREVERBERATION DEVICE AND HEARING AID

(71) Applicant: RION Co., Ltd., Tokyo (JP)

(72) Inventors: Masatoshi Osawa, Tokyo (JP); Masahiro Sunohara, Tokyo (JP); Yoichi Fujisaka, Tokyo (JP); Yoko Fujishima, Tokyo (JP)

(73) Assignee: RION Co., Ltd., Tokyo (JP)

( * ) Notice: Subject to any disclaimer, the term of this patent is extended or adjusted under 35 U.S.C. 154(b) by 0 days.

(21) Appl. No.: 16/279,486

(22) Filed: Feb. 19, 2019

(65) Prior Publication Data

US 2019/0267021 A1 Aug. 29, 2019

(30) Foreign Application Priority Data

Feb. 23, 2018 (JP) ..... 2018-031211

(51) Int. Cl.

| | |
|---|---|
| ***G10L 21/0208*** | (2013.01) |
| ***G10K 15/08*** | (2006.01) |
| *H04R 25/00* | (2006.01) |
| *G10L 21/0324* | (2013.01) |

(52) U.S. Cl.

CPC ..... *G10L 21/0208* (2013.01); *G10K 15/08* (2013.01); *G10L 21/0324* (2013.01); *G10L 2021/02082* (2013.01); *H04R 25/505* (2013.01)

(58) Field of Classification Search

CPC ..... G10L 2021/02082; G10L 21/0208; G10L 21/0324; G10K 15/08; H04R 25/505

USPC ..... 381/66, 23.1

See application file for complete search history.

(56) References Cited

U.S. PATENT DOCUMENTS

| | | | | |
|---|---|---|---|---|
| 9,530,429 | B2 * | 12/2016 | Sunohara | G10L 21/0208 |
| 2013/0129099 | A1 | 5/2013 | Kondo | |
| 2016/0064011 | A1 | 3/2016 | Sunohara | |

FOREIGN PATENT DOCUMENTS

| | | | |
|---|---|---|---|
| EP | 2573768 | A2 | 3/2013 |
| JP | 2013130857 | A | 7/2013 |
| JP | 2016054421 | A | 4/2016 |

* cited by examiner

*Primary Examiner* — Paul Kim

(74) *Attorney, Agent, or Firm* — Rankin, Hill & Clark LLP

(57) ABSTRACT

A dereverberation device includes an input instantaneous value calculation unit configured to calculate an input instantaneous value based on an input signal; a reverberation estimation unit configured to calculate a moving average of the input instantaneous value as a reverberation component; a gain calculation unit configured to calculate, with the input instantaneous value and the reverberation component, a first gain as a basic gain for the input signal; a gain suppression control unit configured to calculate, according to a ratio between the input instantaneous value and the reverberation component, a second gain changing within a range between a predetermined lower limit and a predetermined upper limit, thereby outputting a larger one of the first gain or the second gain as a third gain; and a gain processing unit configured to multiply the input signal by the third gain.

7 Claims, 7 Drawing Sheets

DEREVERBERATION DEVICE AND HEARING AID

CROSS-REFERENCE TO RELATED APPLICATION

This application claims priority from Japanese Patent Application No. 2018-031211 filed with the Japan Patent Office on Feb. 23, 2018, the entire content of which is hereby incorporated by reference.

BACKGROUND

1. Technical Field

The present disclosure relates to a dereverberation device configured to reduce a reverberation component contained in an audio signal and a hearing aid including the dereverberation device.

2. Related Art

For example, when a conversation is caught with a hearing aid, reverberation sound reflected on, e.g., a surrounding wall overlaps with the conversation in an easily-echoing building, and for this reason, it is sometimes difficult to catch the conversion. Thus, the function of reducing the reverberation sound to easily catch the conversation has been demanded. Various techniques of reducing, by signal processing, a reverberation component contained in an audio signal have been proposed. For example, in a technique disclosed in JP-A-2016-054421, an input signal instantaneous value and a reverberation component based on the instantaneous value are obtained. In a period in which the instantaneous value is smaller than the reverberation component, a gain value is set to a predetermined gain lower limit. In this manner, the reverberation component is reduced. Moreover, in, e.g., a technique disclosed in JP-A-2013-130857, a reverberation component is adjusted according to a difference between a first index value following a time change in an audio signal and a second index value following, with lower followability than that of the first index value, the time change in the audio signal, and in this manner, is reduced.

SUMMARY

A dereverberation device includes an input instantaneous value calculation unit configured to calculate an input instantaneous value based on an input signal; a reverberation estimation unit configured to calculate a moving average of the input instantaneous value as a reverberation component; a gain calculation unit configured to calculate, with the input instantaneous value and the reverberation component, a first gain as a basic gain for the input signal; a gain suppression control unit configured to calculate, according to a ratio between the input instantaneous value and the reverberation component, a second gain changing within a range between a predetermined lower limit and a predetermined upper limit, thereby outputting a larger one of the first gain or the second gain as a third gain; and a gain processing unit configured to multiply the input signal by the third gain.

DETAILED DESCRIPTION

Figure 1:
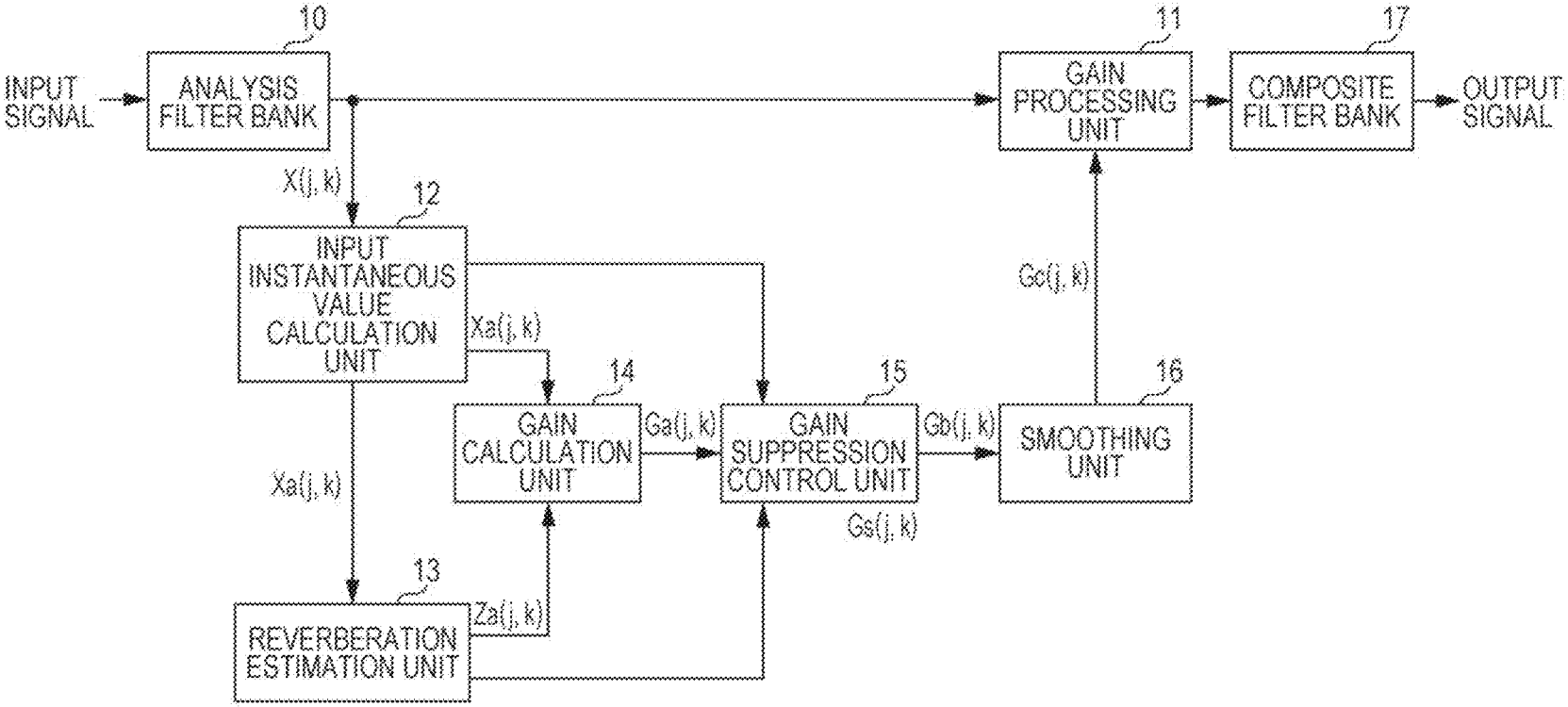
FIG. 1 is a block diagram of a configuration of a dereverberation device according to an embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the case of applying the technique of JP-A-2016-054421, the gain lower limit is set to a low value to sufficiently reduce the reverberation component. However, when the gain lower limit is set to the low value, a gain variation width is large. For this reason, there is a probability that it is difficult to properly set the gain in a situation where sound is intermittently input. For example, in a situation where reverberation occurs after sound has been input for a certain period of time, the gain decreases from a high gain state. In a case where sound is input again immediately afterwards, the gain for start of the sound is suppressed. In a case where stationary environmental noise (e.g., traffic noise and a crowd) is present without sound input, there is a probability that a feeling of discomfort occurs due to excessive unnecessary suppression in the gain.

Moreover, there is a similar probability in the technique of JP-A-2013-130857. Thus, it is difficult to avoid occurrence of a feeling of discomfort due to gain fluctuation and a feeling of discomfort under stationary environmental noise.

Note that in application of each of the techniques of JP-A-2016-054421 and JP-A-2013-130857, a time constant in smoothing processing may be set great as measures against the feeling of discomfort due to gain fluctuation. However, in this case, it is difficult to improve suppression in the gain for start of sound in, e.g., a continuous conversation. Conversely, a situation where gain suppression for the reverberation component is insufficient is also assumed.

One object of the present disclosure is to provide the following dereverberation device and a hearing aid including the dereverberation device. In the dereverberation device, a proper gain for sound can be ensured while a reverberation component can be sufficiently reduced. Further, in the dereverberation device, a feeling of discomfort due to gain fluctuation and stationary environmental noise can be reduced.

A dereverberation device (the present dereverberation device) according to an embodiment of the present disclosure includes an input instantaneous value calculation unit (12) configured to calculate an input instantaneous value (Xa(j, k)) based on an input signal (X(j, k)); a reverberation estimation unit (13) configured to calculate a moving average of the input instantaneous value as a reverberation component (Za(j, k)); a calculation unit (14) configured to calculate, with the input instantaneous value and the reverberation component, a first gain (Ga(j, k)) as a basic gain for the input signal; a gain suppression control unit (15) configured to calculate, according to a ratio between the input instantaneous value and the reverberation component, a second gain (Gs(j, k)) changing within a range between a predetermined lower limit (ηlow(k)) and a predetermined upper limit (ηup(k)), thereby outputting a larger one of the first gain or the second gain as a third gain (Gb(j, k)); and a gain processing unit (11) configured to multiply the input signal by the third gain.

In the present dereverberation device, the first gain calculated according to the input instantaneous value and the reverberation component largely fluctuates, and therefore, the fluctuation of the first gain is suppressed using the second gain, so that an excessive gain decrease can be suppressed. Moreover, in the present dereverberation device, the second gain itself as the suppressed gain is not fixed, and changes within the range between the predetermined lower limit and the predetermined upper limit. Thus, gain fluctuation can be suppressed without increasing a time constant in smoothing processing. Thus, an excessive gain decrease is avoided in a time period with latter part of reverberation sound after sound with a large amplitude has been input, and the suppressed gain sufficiently returns at the start of subsequent sound. Thus, naturalness of sound can be maintained while the reverberation component can be sufficiently reduced. Moreover, in environment where only stationary noise is present, unnecessary gain suppression can be avoided.

In the present dereverberation device, the input instantaneous value can be, for example, calculated based on the envelope of a value correlating with the absolute value or the square of the input signal. The reverberation component can be, for example, calculated according to the index moving average of the input instantaneous value. Moreover, the gain suppression control unit of the present dereverberation device preferably controls the second gain to gradually decrease the second gain toward the lower limit in a case where the input instantaneous value is smaller than the reverberation component (see Formula (3)) and increase the second gain toward the upper limit in other cases (see Formula (4)). In this manner, two calculation methods are switched according to a magnitude relationship between the input instantaneous value and the reverberation component, so that the second gain can be easily increased/decreased. There are various calculation methods in this case. Specifically, the gain suppression control unit can decrease the second gain according to Formula (3) described later, and can increase the second gain according to Formula (4) described later.

The present dereverberation device may further include a smoothing unit (16) configured to perform smoothing by smoothing processing for the third gain. Thus, fluctuation in the third gain after suppression using the second gain can be suppressed by the further smoothing processing. Note that in a case where fluctuation in the third gain is sufficiently small, the present dereverberation device does not necessarily include the smoothing unit.

The present dereverberation device may further include an analysis filter bank (10) configured to divide an external input signal into multiple input signals as multiple frequency band components, and a composite filter bank (17) configured to synthesize the multiple frequency band components output from the gain processing unit to generate an output signal. Multiple input instantaneous value calculation units, multiple reverberation estimation units, multiple gain calculation units, and multiple gain suppression control units may be each provided corresponding to multiple frequency bands.

In this case, the above-described lower and upper limits are preferably set separately for each of the multiple frequency bands. Thus, characteristics different among the multiple frequency bands can be reflected while the gain can be separately suppressed. Thus, proper gain control with a high flexibility can be performed.

A hearing aid according to an embodiment of the present disclosure includes a microphone (20) configured to convert sound into an electric signal; a receiver (22) configured to convert an electric signal into sound; an input instantaneous value calculation unit configured to calculate an input instantaneous value based on an input signal extracted from an output signal from the microphone; a reverberation estimation unit configured to calculate a moving average of the input instantaneous value as a reverberation component; a gain calculation unit configured to calculate, with the input instantaneous value and the reverberation component, a first gain as a basic gain for the input signal; a gain suppression control unit configured to calculate, according to a ratio between the input instantaneous value and the reverberation component, a second gain changing within a range between a predetermined lower limit and a predetermined upper limit, thereby outputting a larger one of the first gain or the second gain as a third gain; and a hearing aid processing unit (21) configured to perform hearing aid processing according to a user for the input signal and including a gain processing unit configured to multiply the input signal by the third gain.

As described above, according to the present dereverberation device, the proper gain for sound, and the like can be maintained while the reverberation component can be effectively reduced. Further, in occurrence of gain fluctuation, stationary environmental noise, and the like, unnecessary gain suppression is avoided. Thus, a feeling of discomfort due to dereverberation can be effectively reduced.

Hereinafter, one embodiment of the present disclosure will be described with reference to the attached drawings. In the present embodiment, a dereverberation device and a hearing aid including the dereverberation device will be described as one example of the technique of the present disclosure.

FIG. 1 is a block diagram of a configuration of the dereverberation device according to one embodiment of the present disclosure. The dereverberation device illustrated in FIG. 1 includes an analysis filter bank 10, a gain processing unit 11, an input instantaneous value calculation unit 12, a reverberation estimation unit 13, a gain calculation unit 14, a gain suppression control unit 15, a smoothing unit 16, and a composite filter bank 17. Each element included in the configuration of FIG. 1 can be implemented by signal processing with a digital signal processor (DSP) configured so that digital signal processing can be executed, for example.

In this dereverberation device, an external input signal containing an audio signal, and the like is input to the analysis filter bank 10. The analysis filter bank 10 is configured to digitalize the external input signal as a processing target for each frame as a predetermined time interval. The analysis filter bank 10 is configured to divide the digitalized signal into multiple input signals as multiple frequency band components.

For example, a window function and fast Fourier transform (FFT) corresponding to each of M frequency bands (M is an integer of two or more) can be used as the analysis filter bank 10. In this case, each of M input signals output from the analysis filter bank 10 relates to a j-th frame on a time axis and a k-th (k: an integer of 1 to M) frequency band, and is represented by X(j, k). Hereinafter, other signals will be also similarly represented in principle.

The gain processing unit 11 is configured to generate signals in such a manner that the M input signals X(j, k) divided by the analysis filter bank 10 are multiplied by gains each corresponding to the input signals X(j, k). In this case, the gains used in the gain processing unit 11 are obtained by later-described processing with components including the input instantaneous value calculation unit 12, the reverberation estimation unit 13, the gain calculation unit 14, the gain suppression control unit 15, and the smoothing unit 16. These components include multiple components having the same structure and each corresponding to the M input signals X(j, k). These components are arranged in parallel (FIG. 1 illustrates only a single system).

The input instantaneous value calculation unit 12 is configured to calculate an input instantaneous value Xa(j, k) in such a manner that the value of the envelope (the time envelope) of the power of the input signal X(j, k) is estimated. The input instantaneous value Xa(j, k) in this case is equivalent to an input power estimation value correlating with the square of the input signal X(j, k). Note that the value of the envelope of an amplitude may be estimated to obtain the input instantaneous value Xa(j, k). That is, instead of the input power estimation value, an input amplitude estimation value correlating with an absolute value of the input signal X(j, k) may be used as the input instantaneous value Xa(j, k).

The reverberation estimation unit 13 is configured to calculate an index moving average value of the input instantaneous value Xa(j, k) obtained by the input instantaneous value calculation unit 12, thereby estimating such a value as a reverberation component Za(j, k). The reverberation estimation unit 13 is configured to output the estimated reverberation component Za(j, k). For example, the reverberation component Za(j, k) is obtained as follows. That is, while multiple input instantaneous values Xa(j, k) within a predetermined time range are held, weighting for providing an index decrease is performed according to time for holding each input instantaneous value Xa(j, k). Then, the index moving average at this point is sequentially calculated, so that the reverberation component Za(j, k) can be obtained. Note that the reverberation estimation unit 13 is not limited to the index moving average, but other types of processing with a weighted moving average may be employed.

The gain calculation unit 14 is configured to calculate, with the input instantaneous value Xa(j, k) and the reverberation component Za(j, k) obtained by the input instantaneous value calculation unit 12 and the reverberation estimation unit 13, a first gain Ga(j, k) as a basic gain for the input signal X(j, k). For calculating the first gain Ga(j, k), various calculation formulae can be applied. For example, the first gain Ga(j, k) can be calculated based on Formula (1) below.

$$Ga(j,k) = \left\{\frac{Xa(j,k)^a - Za(j,k)^a}{Xa(j,k)^a}\right\}^b \tag{1}$$

Note that a and b are values set as necessary according to the method for calculating the input instantaneous value Xa(j, k).

Note that other methods for calculating the first gain Ga(j, k) may include, for example, a spectral subtraction method, a Wiener filtering method, and a minimum mean-square-error short-time spectral amplitude (MMSE-STSA) method.

The gain suppression control unit 15 is configured to set, with the above-described input instantaneous value Xa(j, k) and the above-described reverberation component Za(j, k), a suppressed second gain Gs(j, k). Further, the gain suppression control unit 15 is configured to select and output a third gain Gb(j, k) based on a result of comparison between the set second gain Gs(j, k) and the above-described first gain Ga(j, k). Hereinafter, a specific processing example in the gain suppression control unit 15 will be described with reference to a flowchart of FIG. 2 and Formulae (2), (3), and (4).

Figure 2:
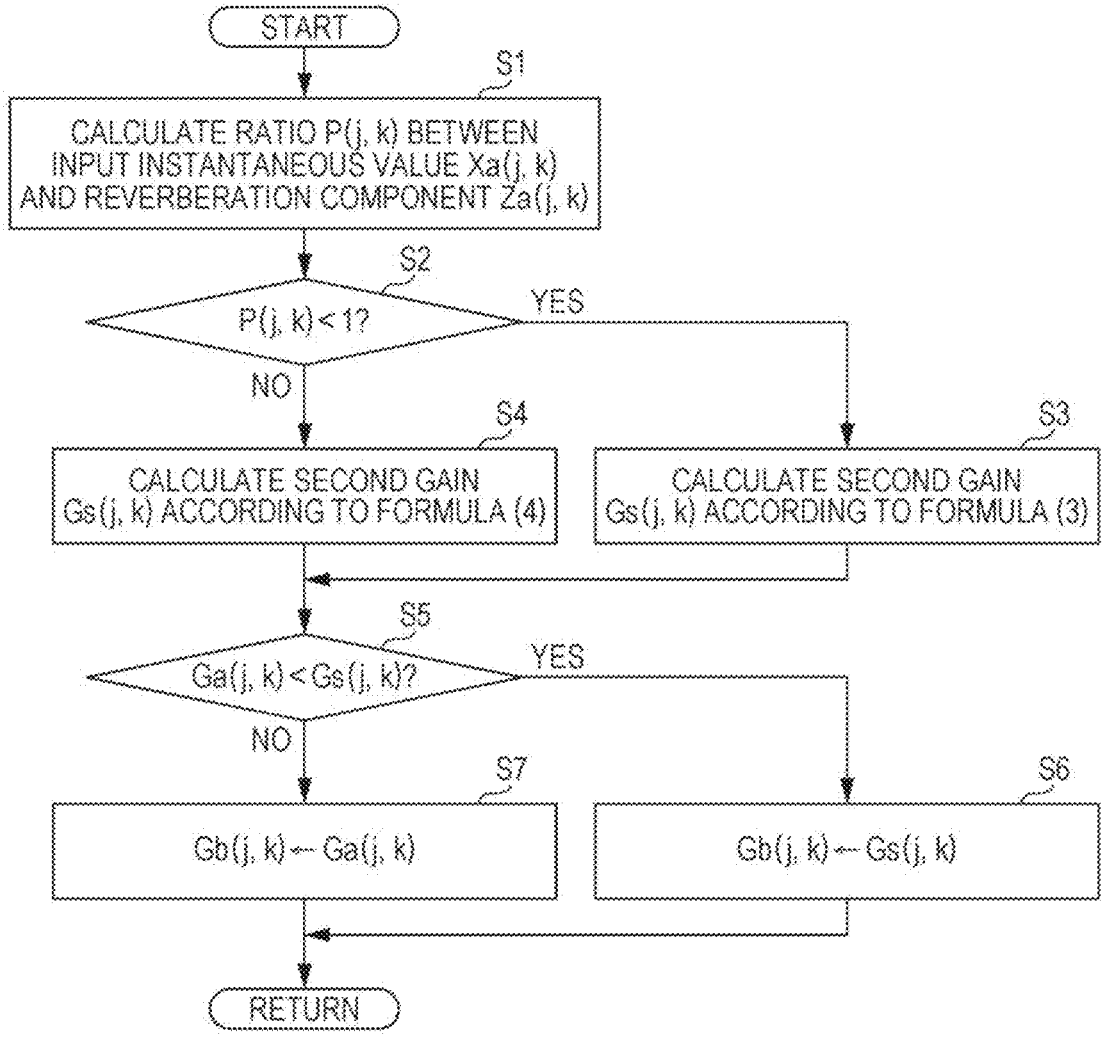
FIG. 2 is a flowchart of a specific processing example in a gain suppression control unit.

First, as illustrated in FIG. 2, the gain suppression control unit 15 receives the input instantaneous value Xa(j, k) obtained by the input instantaneous value calculation unit 12 and the reverberation component Za(j, k) obtained by the reverberation estimation unit 13, thereby calculating a ratio P(j, k) between these values according to Formula (2) below (a step S1).

$$P(j,k) = \frac{Xa(j,k)}{Za(j,k)} \tag{2}$$

Then, the gain suppression control unit 15 determines whether or not the ratio P(j, k) calculated at the step S1 satisfies P(j, k)<1 (a step S2). As a result of determination at the step S2, in a case where P(j, k)<1 is satisfied (the step S2: YES), the gain suppression control unit 15 calculates the second gain Gs(j, k) according to Formula (3) below (a step S3).

$$Gs(j,k)=\alpha 1\,Gs(j-1,k)+(1-\alpha 1)\max(\eta\mathrm{low}(k),P(j,k)^{\beta}) \tag{3}$$

Note that ηlow(k): the lower limit of the second gain set for each frequency band;

a1, β: coefficients set according to characteristics of Formula (3); and max( ): a function returning the maximum value of elements.

On the other hand, in a case where P(j, k)<1 is not satisfied as a result of determination of the step S2 (the step S2: NO), the gain suppression control unit 15 calculates the second gain Gs(j, k) according to Formula (4) below (a step S4).

$$Gs(j,k)=\alpha 2\,Gs(j-1,k)+(1-\alpha 2)\eta\mathrm{up}(k) \tag{4}$$

Note that ηup(k): the upper limit of the second gain set for each frequency band; and a2: a coefficient set according to characteristics of Formula (4).

Note that in Formulae (3) and (4), the second gain Gs(j−1, k) for the preceding frame is used. Thus, the second gain Gs(j, k) sequentially changes with the lapse of time. Moreover, a1 and a2 in Formulae (3) and (4) have a role in setting the time rate of change in the second gain Gs(j, k). As the values of a1 and a2 increase, the second gain Gs(j, k) changes rapidly. Moreover, β in Formula (3) has a role in adjusting the value of the second gain Gs(j, k) according to the ratio P(j, k).

Then, the gain suppression control unit 15 derives the third gain Gb(j, k) based on the second gain Gs(j, k) calculated at the steps S3, S4. That is, in a case where the first gain Ga(j, k) is smaller than the second gain Gs(j, k) (a step S5: YES), the gain suppression control unit 15 sets the value of the second gain Gs(j, k) as the third gain Gb(j, k) (a step S6). On the other hand, in a case where the first gain Ga(j, k) does not fall below the second gain Gs(j, k) (the step S5: NO), the gain suppression control unit 15 directly sets the first gain Ga(j, k) as the third gain Gb(j, k) (a step S7). In this manner, the suppressed third gain Gb(j, k) is output from the gain suppression control unit 15.

In the present embodiment, the second gain Gs(j, k) change, by calculation according to Formulae (3) and (4) as described above, in two ways according to a magnitude relationship between the input instantaneous value Xa(j, k) and the reverberation component Za(j, k). That is, in a situation where the input instantaneous value Xa(j, k) appears due to, e.g., sound from the outside and is larger than the reverberation component Za(j, k), the second gain Gs(j, k) increases within a range not exceeding the upper limit ηup(k) according to Formula (4). On the other hand, in a situation where the input instantaneous value Xa(j, k) decreases and is lower than the reverberation component Za(j, k), the second gain Gs(j, k) decreases within a range not falling below the lower limit ηlow(k) according to Formula (3).

As described above, in the present embodiment, the second gain Gs(j, k) is limited to within a range between the upper limit ηup(k) and the lower limit ηlow(k). Features and advantageous effects obtained by such limitation will be described later.

Next, the smoothing unit 16 is, as illustrated in FIG. 1, configured to perform smoothing by smoothing processing along the time axis for the third gain Gb(j, k) output from the gain suppression control unit 15. Thus, the smoothing unit 16 outputs a gain Gc(j, k) whose temporal fluctuation is smoothed. In the smoothing processing in the smoothing unit 16, the smoothed gain Gc(j, k) can be obtained in such a manner that the index moving average of the input third gain Gb(j, k) is sequentially calculated, for example. Note that when the third gain Gb(j, k) temporally and sufficiently smoothly changes, the smoothing unit 16 may be omitted.

The above-described gain processing unit 11 is configured to multiply the gain Gc(j, k) output from the smoothing unit 16 by the input signal X(j, k) for the corresponding frequency band. Then, the composite filter bank 17 at a subsequent stage is configured to synthesize the M frequency band components output from the gain processing unit 11 for each frame, thereby generating an output signal of the dereverberation device.

For example, inverse fast Fourier transform (IFFT) and a window function corresponding to each of the M frequency bands can be used as the composite filter bank 17.

Note that a case where each of the input signals X(j, k) divided according to the frequency band is processed has been described regarding the dereverberation device according to the present embodiment. Instead, the processing according to the present embodiment may be applied to all frequency components without using the analysis filter bank 10 and the composite filter bank 17.

Next, specific features and advantageous effects in the dereverberation device according to the present embodiment will be described. FIGS. 3A to 3D and 4A to 4C are graphs for describing characteristics of the dereverberation device of the present embodiment verified by simulation in comparison with those of a typical method. FIGS. 3A to 3D illustrate the characteristics in a case where audio signals are intermittently input under environment with much reverberation. FIGS. 4A to 4C illustrate the characteristics under environment where only surrounding stationary noise is present.

Figure 3A:
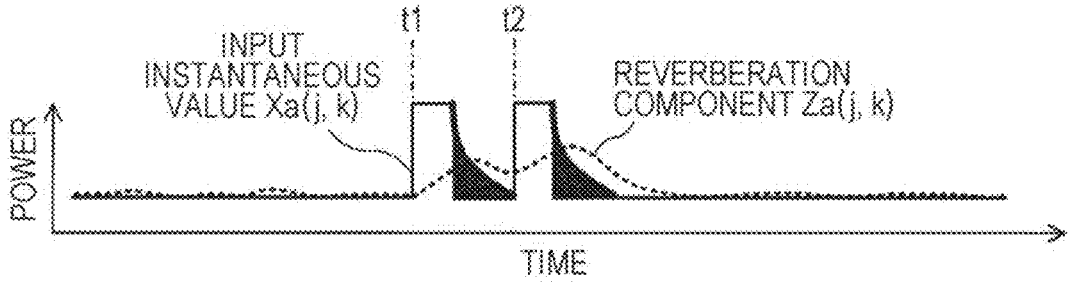
FIGS. 3A to 3D illustrate characteristics of the dereverberation device of the embodiment verified by simulation in a case where audio signals are intermittently input in environment with much reverberation in comparison with a characteristics of dereverberation device with existing configuration.
Figure 3B:
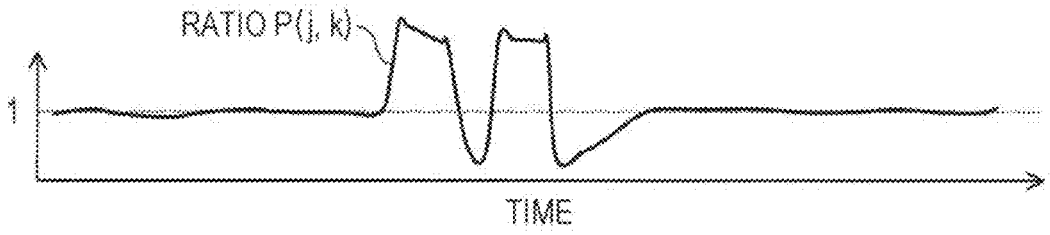
Figure 4A:
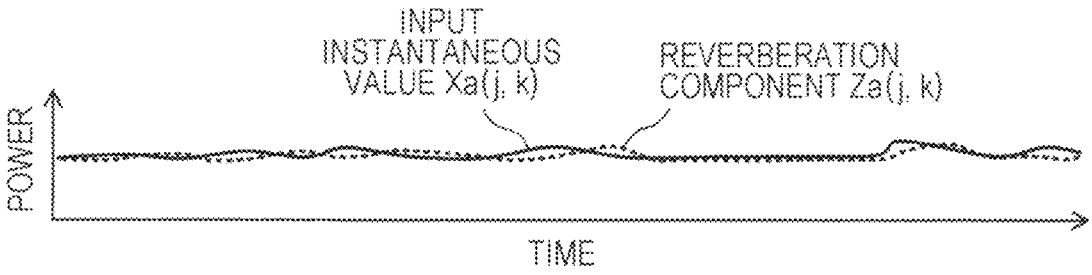
FIGS. 4A to 4C illustrate characteristics of the dereverberation device of the embodiment verified by simulation in environment where only surrounding stationary noise is present.
Figure 4B:
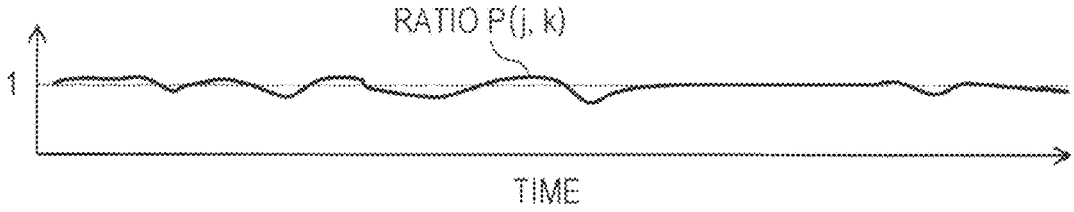
Figure 4C:
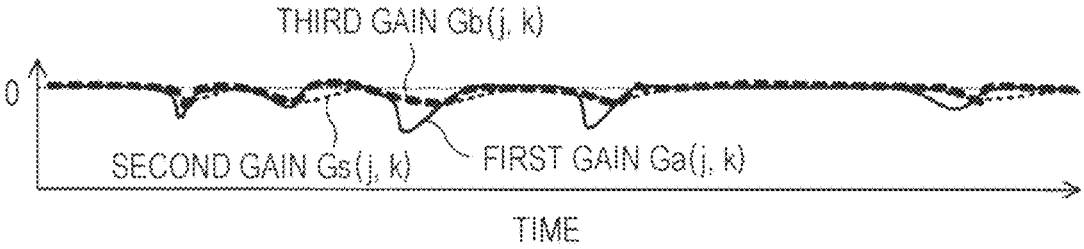

First, as illustrated in FIG. 3A, in a case where relatively-loud sound is intermittently input at time points t1, t2, the power of the input instantaneous value Xa(j, k) falls after having sharply risen at the timing t1, t2. Since there are much reverberation, it is assumed that a gently-falling reverberation waveform (a black portion right after a pulse) follows the falling waveform of the input instantaneous value Xa(j, k). Then, the reverberation component Za(j, k) gently changes behind the input instantaneous value Xa(j, k). Thus, as illustrated in FIG. 3B, the ratio P(j, k) between the input instantaneous value Xa(j, k) and the reverberation component Za(j, k) rapidly increases from around a ratio of 1 at the timing t1, t2. In a so-called subsequent later-stage time period with latter part of reverberation sound, the ratio P(j, k) falls below a ratio of 1. Note that later-stage reverberant sound is equivalent to reverberant sound in a time period in which the input instantaneous value Xa(j, k) decreases and is lower than the reverberation component Za(j, k) and satisfies P(j, k)<1.

Figure 3C:
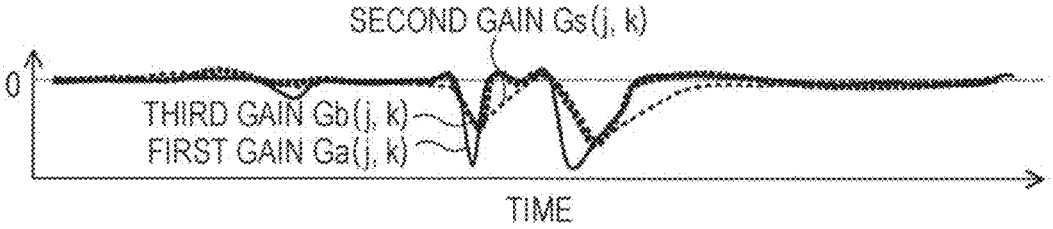

Next, as illustrated in FIG. 3C, the basic first gain Ga(j, k) calculated based on Formula (1) reaches the minimum value while decreasing in the period in which the above-described ratio P(j, k) falls below a ratio of 1. Meanwhile, the second gain Gs(j, k) calculated according to Formulae (3) and (4) changes only within the range between the upper limit ηup(k) and the lower limit ηlow(k). Thus, it is shown that the third gain Gb(j, k) as a larger one of the first gain Ga(j, k) or the second gain Gs(j, k) holds the value of about the half of the minimum value even in a region where the above-described first gain Ga(j, k) is around the minimum value, and thereafter, returns to a ratio of 1 according to the first gain Ga(j, k).

Figure 3D:
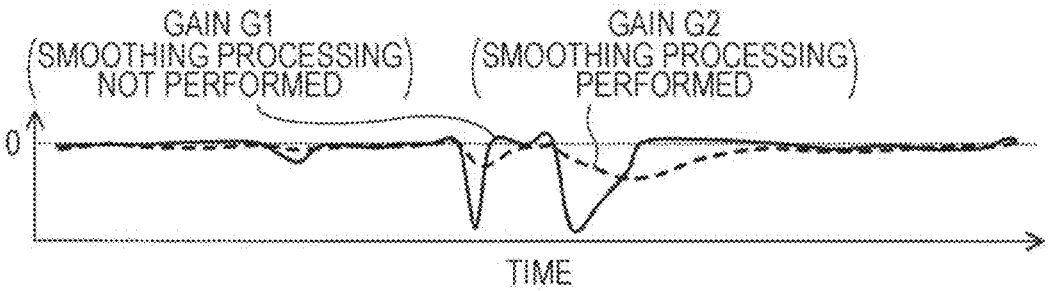

On the other hand, FIG. 3D shows the waveform of a gain G1 in the case of not performing the smoothing processing and the waveform of a gain G2 in the case of performing the smoothing processing in a dereverberation device based on a typical configuration (see, e.g., JP-A-2016-054421). This figure shows as follows. That is, the gain G1 in the case of not performing the smoothing processing changes substantially similarly to the first gain Ga(j, k) of FIG. 3C. On the other hand, the gain G2 in the case of performing the smoothing processing changes wholly and more gently as compared to the gain G1.

The first gain Ga(j, k) of FIG. 3C and the gain G1 in the case of not performing the smoothing processing in FIG. 3D show large gain fluctuation. Thus, the above-described gain for the later-stage reverberant sound becomes unnecessarily small. For this reason, these gains are a cause for a feeling of discomfort with reverberant sound and stationary noise. As measures against such a cause, the value of the third gain Gb(j, k) of FIG. 3C is equal to or larger than the minimum value of the second gain Gs(j, k) even in a case where the value of the third gain Gb(j, k) decreases according to first later-stage reverberant sound. Thereafter, the value of the third gain Gb(j, k) returns according to the first gain Ga(j, k). Thus, a sufficient gain value can be ensured for input sound at the timing t2. On the other hand, the gain G2 of FIG. 3D properly decreases by the smoothing processing, but return timing is late. Thus, the value of the gain for input sound at the timing t2 is suppressed.

Next, in the environment where only the surrounding stationary noise is present, the amount of change in the input instantaneous value Xa(j, k) is relatively small as illustrated in FIG. 4A. Thus, the amount of change in the reverberation component Za(j, k) is also small. In this case, the magnitude relationship between the input instantaneous value Xa(j, k) and the reverberation component Za(j, k) is calculated according to the above-described rules. As illustrated in FIG. 4B, the ratio P(j, k) between these values gently changes within a narrow range around 1. In this situation, as illustrated in FIG. 4C, fluctuation in the above-described first gain Ga(j, k) is smaller than that of the first gain Ga(j, k) of FIG. 3C. As in the above-described case, the third gain Gb(j, k) does not become much smaller than the minimum value of the first gain Ga(j, k), and returns in a short period of time. Thus, a stable gain for the stationary noise can be ensured. On the other hand, in the case of the typical configuration, even when the smoothing processing is performed for the gain G1 in the case of not performing the smoothing processing as illustrated in FIG. 3D, the return timing of the gain is late as in FIG. 3D. Thus, gain fluctuation for the stationary noise cannot be avoided in general.

Figure 5A:
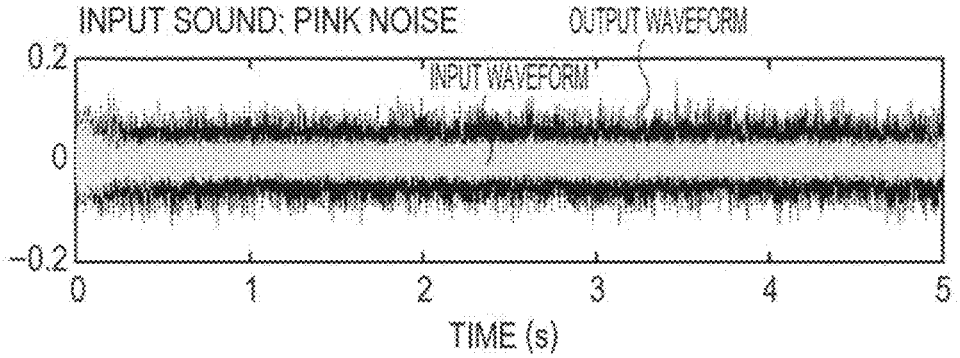
FIGS. 5A to 5C illustrate verification results of characteristics of input and output waveforms compared between the dereverberation device of the embodiment and dereverberation device with existing configuration, assuming that pink noise as the stationary noise is present in the verification.
Figure 5B:
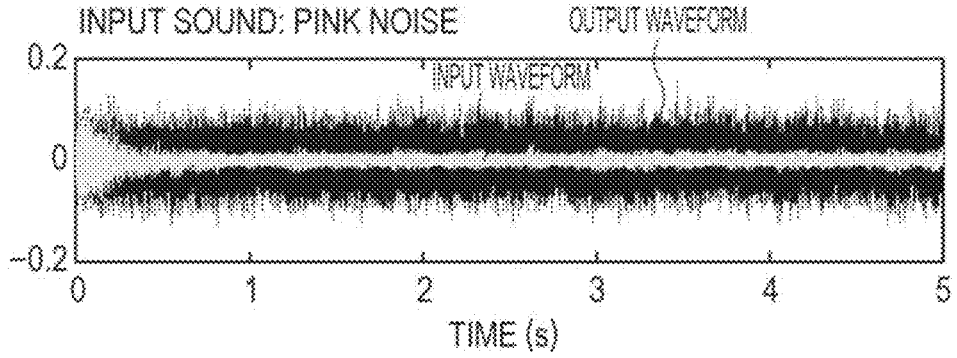
Figure 5C:
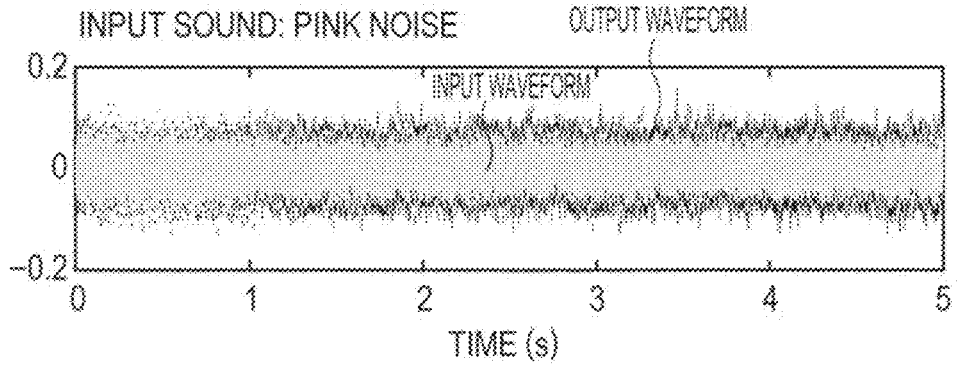
Figure 6A:
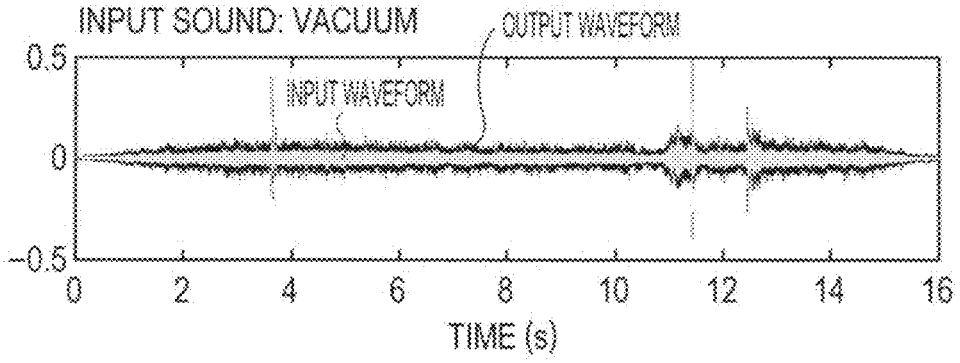
FIGS. 6A to 6C illustrate verification results of characteristics of input and output waveforms compared between the dereverberation device of the embodiment and dereverberation device with existing configuration, assuming that vacuum cleaner sound as the stationary noise is present in the verification.
Figure 6B:
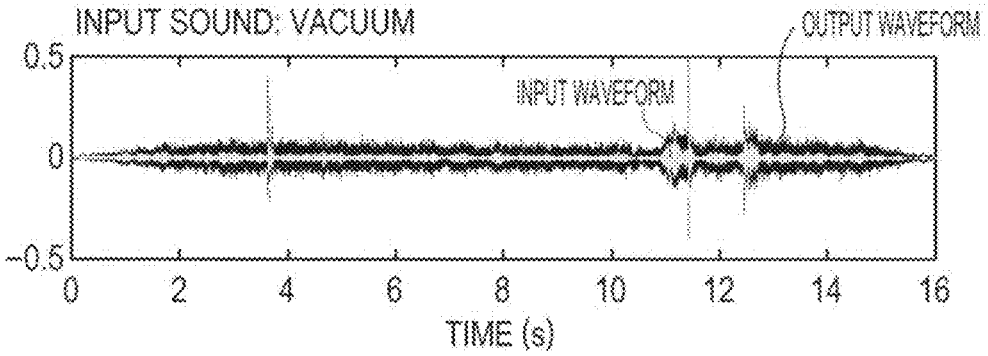
Figure 6C:
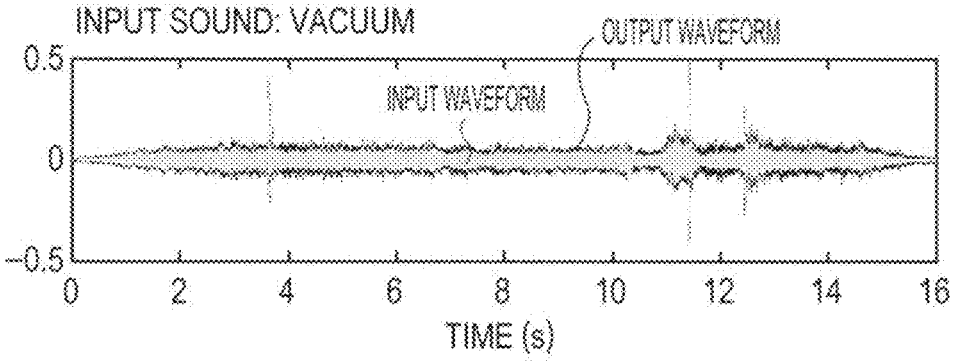

Next, FIGS. 5A to 5C and 6A to 6C illustrate verification results of characteristics of input and output waveforms in the dereverberation device according to the present embodiment and the typical configuration. In these types of verification, environment where the stationary noise is actually present is assumed. In FIGS. 5A to 5C, pink noise is assumed as the stationary noise. In FIGS. 6A to 6C, sound of a vacuum is assumed as the stationary noise.

FIGS. 5A and 6A illustrate the characteristics of the input and output waveforms in the typical configuration in a case where the gain lower limit is set within a range of −5 to −15 dB (depending on a frequency band). FIGS. 5B and 6B illustrate the characteristics of the input and output waveforms in the typical configuration in a case where the gain lower limit is set to −15 dB (fixed). Further, FIGS. 5C and 6C illustrate the characteristics of the input and output waveforms in the dereverberation device according to the present embodiment.

As illustrated in FIGS. 5A to 5C and 6A to 6C, even in a case where any of the pink noise and the sound of the vacuum is the stationary noise, the output waveform (a black portion) is smaller than the input waveform (a gray portion) according to the typical configuration. That is, it is showed that the value of the gain is insufficient. On the other hand, according to the present embodiment, the input waveform and the output waveform show the same level as illustrated in FIGS. 5C and 6C. That is, it is showed that a proper gain is ensured without an extreme decrease in the value of the gain. As described above, according to the present embodiment, a feeling of discomfort due to gain fluctuation under the environment with stationary noise can be reduced.

Figure 7:
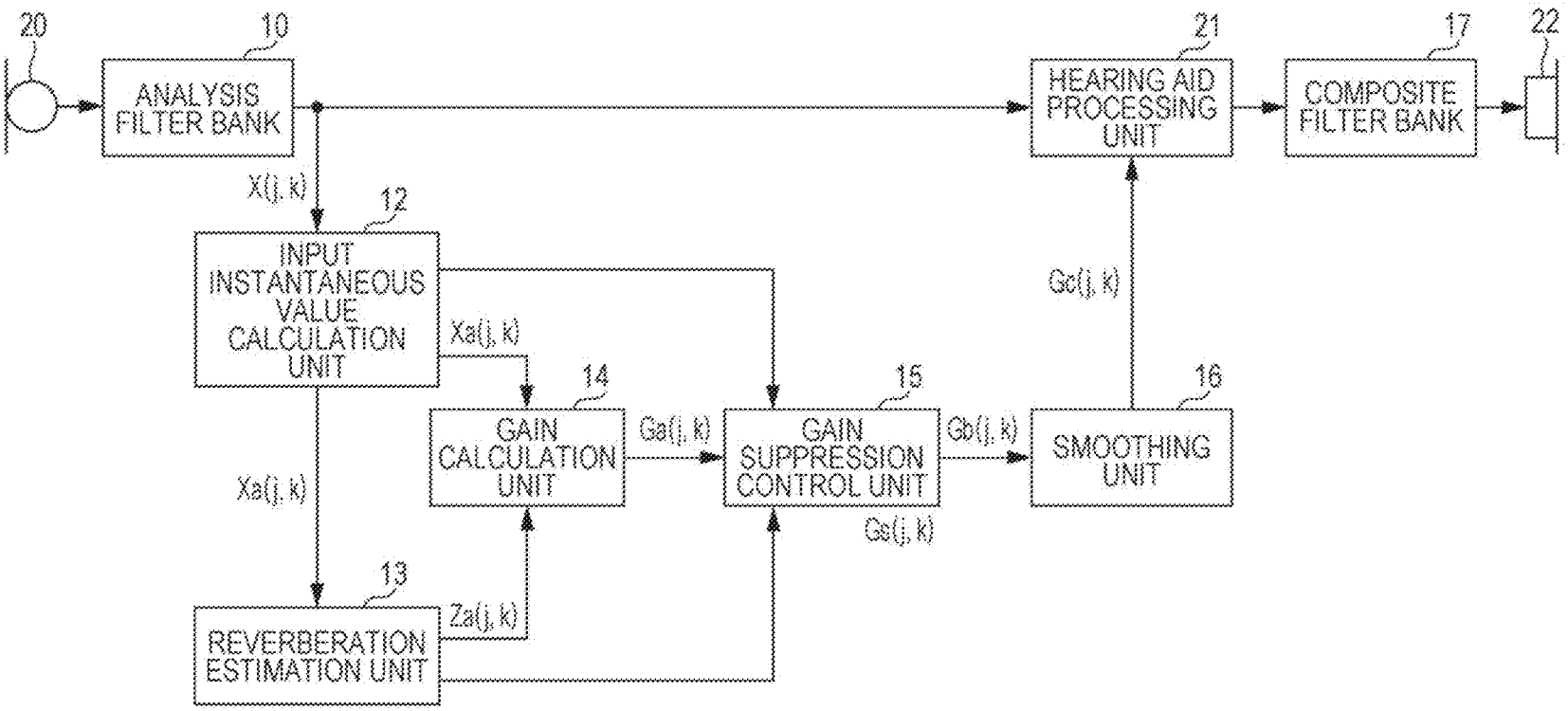
FIG. 7 is a block diagram of a configuration of a hearing aid to which the dereverberation device according to the present embodiment is applied.

The dereverberation device according to the present embodiment can be applied to various uses. FIG. 7 illustrates a configuration example of the hearing aid to which the dereverberation device according to the present embodiment is applied. The hearing aid illustrated in FIG. 7 has the analysis filter bank 10, the input instantaneous value calculation unit 12, the reverberation estimation unit 13, the gain calculation unit 14, the gain suppression control unit 15, the smoothing unit 16, and the composite filter bank 17 illustrated in FIG. 1. The hearing aid further has an input side microphone 20, a hearing aid processing unit 21 with the gain processing unit 11, and an output side receiver 22.

The microphone 20 is configured to convert input sound from the outside to generate an electric signal, thereby outputting the electric signal as an input signal to the analysis filter bank 10. The hearing aid processing unit 21 has the function of performing hearing aid processing such as gain adjustment according to audibility of each user and noise cancellation according to use environment for the input signal X(j, k) for each of the multiple frequency bands, the input signal X(j, k) being output from the analysis filter bank 10. Thus, the hearing aid processing unit 21 includes a component for implementing a function similar to that of the gain processing unit 11 of FIG. 1. The receiver 22 is, for example, placed in the external ear canal of the user, and is configured to convert an output signal from the hearing aid processing unit 21 to generate sound, thereby outputting the sound to a space in the external ear canal. In the hearing aid illustrated in FIG. 7, features and advantageous effects similar to those of the dereverberation device described in the present embodiment can be obtained. Thus, a comfortable hearing aid configured so that a user's feeling of discomfort is reduced can be implemented.

Moreover, the dereverberation device according to the present embodiment can be applied to various other types of equipment than the hearing aid. The equipment to which the dereverberation device according to the present embodiment is applied includes, for example, each configuration illustrated in FIG. 1 or 7, and can implement the functions described in the present embodiment. Such equipment can be used alone or incorporated into other types of equipment. Each component of the dereverberation device can be implemented in such a manner that various processing forms are employed. Various components and various settings for the components can be selected.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A dereverberation device comprising:

an input instantaneous value calculation unit configured to calculate an input instantaneous value based on an input signal;

a reverberation estimation unit configured to calculate a moving average of the input instantaneous value as a reverberation component;

a gain calculation unit configured to calculate, with the input instantaneous value and the reverberation component, a first gain as a basic gain for the input signal;

a gain suppression control unit configured to calculate, according to a ratio between the input instantaneous value and the reverberation component, a second gain changing within a range between a predetermined lower limit and a predetermined upper limit, thereby outputting a larger one of the first gain or the second gain as a third gain; and a gain processing unit configured to multiply the input signal by the third gain.

2. The dereverberation device according to claim 1, wherein the input instantaneous value is calculated based on an envelope of a value correlating with an absolute value or a square of the input signal, and the reverberation component is calculated according to an index moving average of the input instantaneous value.

3. The dereverberation device according to claim 1, wherein the gain suppression control unit gradually decreases the second gain toward the lower limit in a case where the input instantaneous value is smaller than the reverberation component, and increases the second gain toward the upper limit in other cases than the case where the input instantaneous value is smaller than the reverberation component.

4. The dereverberation device according to claim 1, further comprising:

a smoothing unit configured to perform smoothing by smoothing processing for the third gain.

5. The dereverberation device according to claim 1, further comprising:

an analysis filter bank configured to divide an external input signal into multiple input signals as multiple frequency band components; and a composite filter bank configured to synthesize the multiple frequency band components output from the gain processing unit to generate an output signal, wherein each of the multiple frequency bands corresponds to one of the input instantaneous value calculation units, one of the reverberation estimation units, one of the gain calculation units, and one of the gain suppression control units.

6. The dereverberation device according to claim 5, wherein the lower limit and the upper limit are set separately for each of the multiple frequency bands.

7. A hearing aid comprising:

a microphone configured to convert sound into an electric signal;

a receiver configured to convert an electric signal into sound;

an input instantaneous value calculation unit configured to calculate an input instantaneous value based on an input signal extracted from an output signal from the microphone;

a reverberation estimation unit configured to calculate a moving average of the input instantaneous value as a reverberation component;

a gain calculation unit configured to calculate, with the input instantaneous value and the reverberation component, a first gain as a basic gain for the input signal;

a gain suppression control unit configured to calculate, according to a ratio between the input instantaneous value and the reverberation component, a second gain changing within a range between a predetermined lower limit and a predetermined upper limit, thereby outputting a larger one of the first gain or the second gain as a third gain; and a hearing aid processing unit configured to perform hearing aid processing according to a user for the input signal and including a gain processing unit configured to multiply the input signal by the third gain.

* * * * *